US011700947B1

(12) United States Patent
Rodriguez

(10) Patent No.: US 11,700,947 B1
(45) Date of Patent: Jul. 18, 2023

(54) CONVERTIBLE SUPPORT ASSEMBLY

(71) Applicant: Martin J Rodriguez, Miami, FL (US)

(72) Inventor: Martin J Rodriguez, Miami, FL (US)

( * ) Notice: Subject to any disclaimer, the term of this patent is extended or adjusted under 35 U.S.C. 154(b) by 0 days.

(21) Appl. No.: 17/526,887

(22) Filed: Nov. 15, 2021

Related U.S. Application Data

(60) Provisional application No. 63/113,226, filed on Nov. 13, 2020.

(51) Int. Cl.
*A47C 13/00* (2006.01)

(52) U.S. Cl.
CPC ..... *A47C 13/00* (2013.01)

(58) Field of Classification Search
CPC ..... A47C 13/00; A47B 85/04; A47B 2220/07
See application file for complete search history.

(56) References Cited

U.S. PATENT DOCUMENTS 2,705,994 A * 4/1955 Stattler ..... A47C 7/407 297/410
3,004,792 A * 10/1961 Bell ..... A47C 7/407 297/118
3,910,630 A * 10/1975 Runyon ..... A47C 13/00 297/63
4,248,476 A * 2/1981 Phelps ..... A47C 13/00 297/238
4,382,627 A * 5/1983 Dean ..... A47C 13/00 297/121
5,098,153 A * 3/1992 Antoine ..... A47C 4/52 297/125
5,647,632 A * 7/1997 Fireman ..... A47B 85/00 297/283.1
7,207,624 B2 * 4/2007 Hoffman ..... A47C 3/16 297/118
7,681,945 B1 * 3/2010 Wiecek ..... A47C 13/00 297/118
11,439,242 B1 * 9/2022 Norton ..... A47C 7/624
11,439,243 B2 * 9/2022 Norton ..... A47C 13/00
2005/0253424 A1 * 11/2005 Thomas ..... A47C 17/62 297/119
2014/0239680 A1 * 8/2014 Short ..... A47C 1/00 297/125
2016/0051047 A1 * 2/2016 Natuzzi ..... B60P 3/36 297/65
2020/0107642 A1 * 4/2020 Weldon ..... A47C 13/00
2020/0237103 A1 * 7/2020 Norton ..... A47B 83/024
2021/0112968 A1 * 4/2021 Ponomar ..... A47B 3/02
2022/0176190 A1 * 6/2022 Pena ..... A63B 22/0235

* cited by examiner

*Primary Examiner* — Shin H Kim
(74) *Attorney, Agent, or Firm* — Malloy & Malloy, PL

(57) ABSTRACT

A support assembly for an individual convertible into a plurality of different supportive orientations, including a base having opposed front and rear segments and a leg structure connected thereto. The base is selectively disposable in a chair configuration along the front segment or a bench configuration along the rear segment. The support assembly includes structural and operative features which facilitate support thereof in the chair configuration or the bench configuration by at least the base, the arm structure and outer ends of the leg structure being movably and/or relatively positioned to engage a support surface in supporting relation to the support assembly, dependent on its orientation in either the chair or bench configuration.

16 Claims, 16 Drawing Sheets

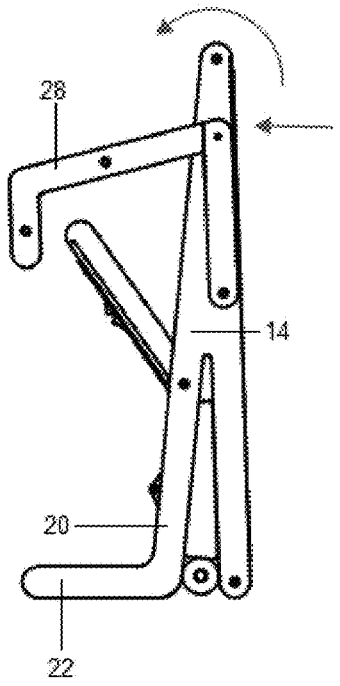
Fig, 6A
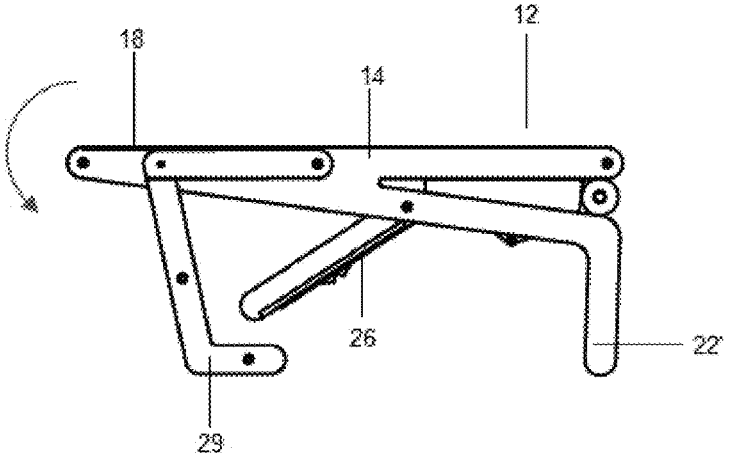
Fig. 6B

Fig. 7A
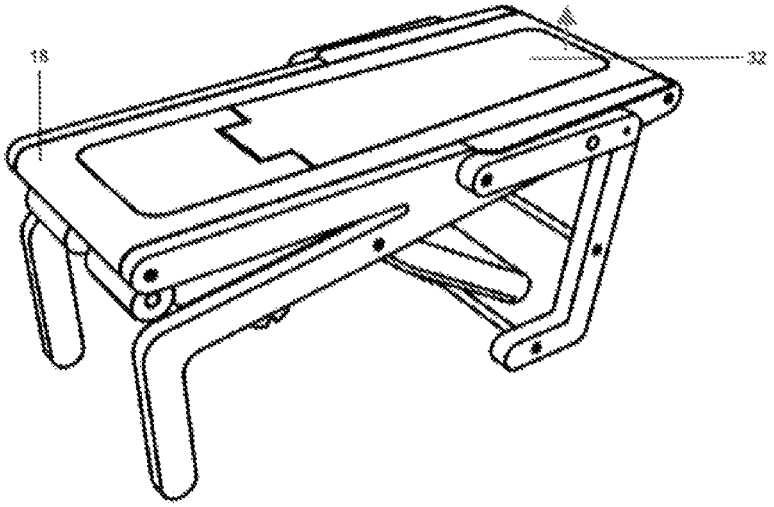
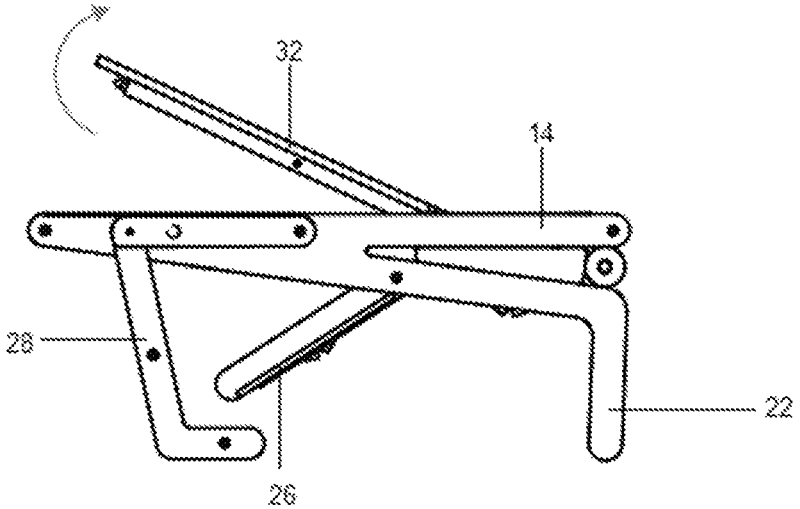
Fig. 7B

Fig. 7C
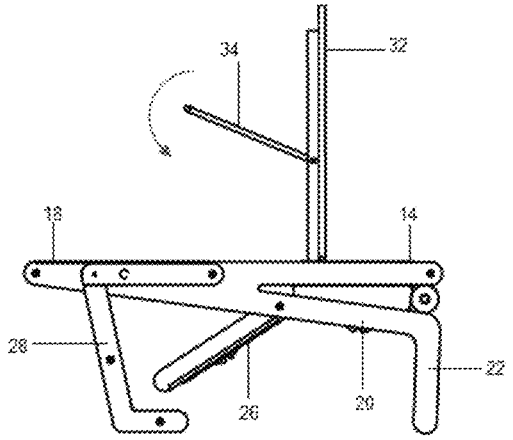
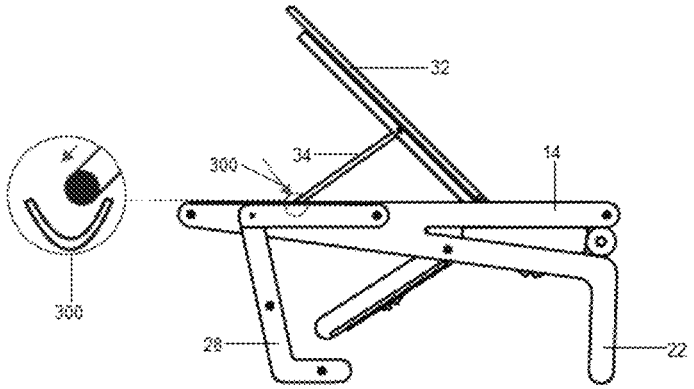
Fig. 7D

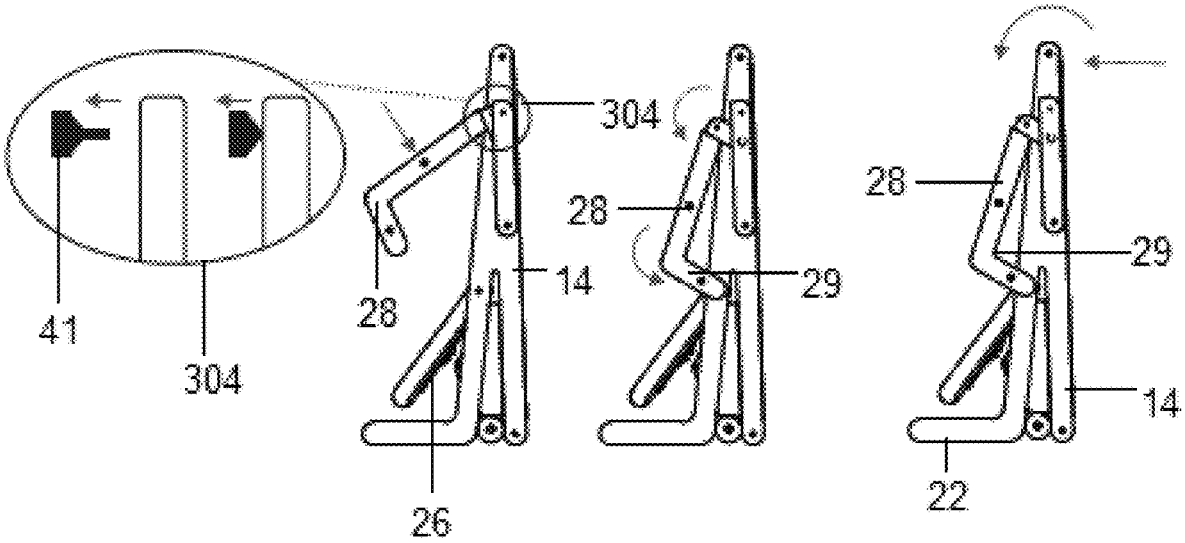
Fig. 11A Fig. 11B Fig, 11C

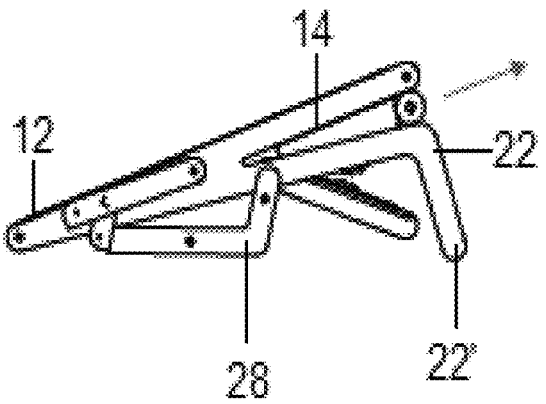
Fig, 12A
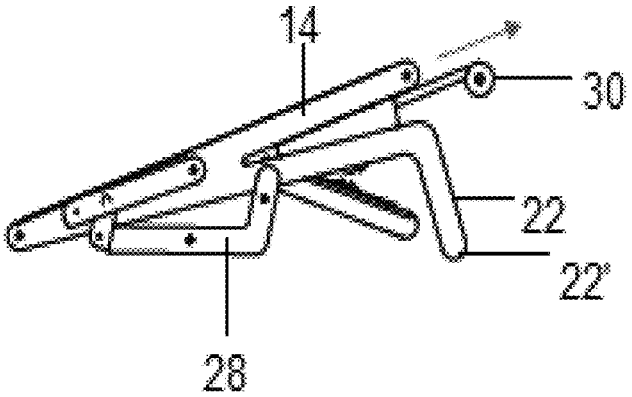
Fig. 12B

CONVERTIBLE SUPPORT ASSEMBLY

CLAIM OF PRIORITY

This present application is based on and a claim of priority is made under 35 U.S.C. Section 119(e) to a provisional patent application in the U.S. Patent and Trademark Office, namely, that having Ser. No. 63/113,226 and a filing date of Nov. 13, 2020, and which is incorporated herein by reference.

BACKGROUND OF THE INVENTION

Field of the Invention

A support assembly for an individual, selectively disposable in at least first and second supportive orientations. The first supportive orientation comprises components of the support assembly interconnected to one another to define a chair configuration and the second supportive orientation comprises the components interconnected to one another to define a bench configuration.

Description of the Related Art

Recent events including, but not limited to, events relating to a pandemic environment have stressed the importance of being able to work from home instead of working from a commercial office or other area independent of the home. Unfortunately, many people don't have the luxury of having a spare workout room or a designated workout area in their home or place of residence. Limitations of this type prevent individuals from being able to properly exercise and/or purchase or otherwise procure proper workout equipment. This is due, at least in part, because of typically restricted space in the home, wherein most spaces or areas are designated for other purposes or events. This becomes even more evident when it is desired to practice or perform more strenuous exercise procedures including, but not limited to weightlifting. This is due in large part to the fact that weight lifting entails not only the use of free weights or "dumbbells" but also requires a workout bench. The majority of such structures which are readily available are not easily broken down into a collapsed orientation for storage or reconfigured to accommodate the exercise being performed. Moreover, support assemblies, particularly of the type which facilitates weightlifting workouts, frequently require a workout bench to be changed into multiple positions such as a horizontal position, a substantially horizontal reclined position and an angularly disposed inclined position. While workout benches of the type referred to are commercially available and also available to individuals in gyms, or other commercial workout facilities, they still have the noted advantage of taking up a comparatively large amount of space and also include the structural and operative disadvantages relating to being broken down to facilitate storage in a reduced volume or area.

The aforementioned recent events, such as those relating to a pandemic environment, have also forced working individuals to have a dedicated "work from home" area. Such work areas also commonly require the use of a desk and a cooperatively structured, sized and/or configured chair.

Therefore, there is a need in current times for a support assembly capable of supporting an individual in a variety of different supportive orientations specifically including a chair capable of being used in a conventional work at home environment and having sufficient structural and operative versatility to be converted into a workout bench of the type set forth above, which includes the ability to be reconfigured to accommodate a variety of different workout techniques including, but not limited to weightlifting.

Such an improved and proposed support assembly should be designed with both health and ergonomics in mind. This can be accomplished by combining a workout bench with a chair into a single support assembly, while avoiding the sacrifice of functionality and/or comfort. In more specific terms, a chair configuration of such an improved and proposed support assembly should be sufficiently comfortable to allow an individual to occupy it in a conventional seated position for an entire workday. Further, when in a chair configuration or a workout bench configuration, sturdiness or a "professional feel" should not be compromised. Additional features which would overcome noted disadvantages in prior art or commercially available support assemblies should include easy assembly for use and equally easy and efficient breakdown for storage in a reduced volume or area.

Such a preferred and proposed support assembly should also be formed of reliable, sturdy, comparatively high-strength material, while at the same time incorporating components which are designed and structured to facilitate comfortable use in either of a possible two supportive orientations respectively and independently defining the aforementioned chair configuration and workout bench configuration.

SUMMARY OF THE INVENTION

The present invention is directed to an assembly for supporting an individual in a plurality of different orientations including, but not necessarily limited to, a first supportive orientation and a second supportive orientation. Further, the support assembly includes an elongated base having a front segment and a rear segment which are oppositely disposed on opposing sides of the base. The first supportive orientation comprises the front segment disposed in a chair configuration and the second supportive orientation comprises the rear segment disposed in a bench configuration. Accordingly, as set forth in greater detail hereinafter, the structural and operative versatility of the one or more embodiments of the present invention facilitates the selective conversion between the chair configuration and the bench configuration.

The chair configuration comprises a backrest, a seat and an armrest structure movably and collectively connected to one another to define a substantially upright position of the support assembly when in the chair configuration. Moreover, the armrest structure comprises a pair of armrests disposed in spaced relation to one another, wherein each of the pair of armrests is disposed in an arm supporting position, relative to the arms of a seated individual. In cooperation therewith, the seat and the backrest will be disposed in substantially conventional supporting relation to the correspondingly positioned body parts of the seated individual.

The support assembly further comprises an elongated leg structure which may be integrally or otherwise fixedly connected to the base. The elongated leg structure includes one outer or free end extending transversely outward from the remainder of the leg structure and from the front segment concurrent to disposition in of the assembly in the chair configuration. Moreover, support for the chair configuration comprises the one outer or free end of the leg structure and a correspondingly positioned end of the base being concurrently disposed in engaging relation to a supporting surface.

As such, the disposition of at least a majority of the length of the one end of the leg structure is accomplished by a spaced, separated relation of the elongated leg from the remainder of the base along an entirety or at least a majority of the length of the elongated leg structure. As such the one end of the leg structure is also disposed in outwardly spaced relation to the base. Further, in one or more embodiments the leg structure comprises two spaced apart legs disposed on different longitudinal sides of the base and extending in spaced, separated relation from base along with an outer end of each of the legs.

The alternate or second supportive orientation defining the bench configuration of the assembly, comprises the rear segment of the base disposed in an outwardly or upwardly exposed, reclined position, concurrently to the front segment being disposed in a downwardly, substantially nonexposed position. The nonexposed position of the front segment comprising it facing downwardly, towards the support surface on which the bench configuration of the support assembly is disposed. The aforementioned reclined position may be accurately defined and disclosed as a substantially horizontal or alternatively angularly inclined orientation which facilitates the support of an individual on the exposed surface of the rear segment. When in the substantially horizontal, inclined position, the bench configuration is supported by the outer end of the leg structure and outer extremities of the armrests being concurrently disposed in engaging relation to a supporting surface. Alternately, when the rear segment is disposed in an angularly inclined position, support therefore comprises an outer extremity of the outer end of the leg structure and a majority of the length of the armrest structure concurrently engaging the supporting surface.

Therefore, the versatility of the support assembly includes structural and operative features which facilitate support thereof in the chair configuration and the bench configuration by at least the base, the arm structure and outer ends of the leg structure being movably and/or relatively positioned so as to engage a supporting surface in supporting relation to the support assembly when in the first and second supportive orientations. By way of example, the armrest structure is movably connected to the base and selectively positioned between the aforementioned arm supporting position relative to a seated individual, when in the chair configuration and alternatively into engagement with a supporting surface and supporting relation to the base concurrent to the support assembly being disposed in the bench configuration.

Additional structural and operative features of support assembly, when in the bench configuration, include the rear segment comprising a back support movably connected to the base and to the rear segment and being alternatively disposable in a collapsed position and/or an outwardly extended position concurrent to the support assembly being in the bench configuration. Moreover, when the back support extends outwardly from the base and/or rear segment it may be disposed in a transverse, substantially perpendicular relation to the rear segment or alternatively in one of the plurality of transverse orientations having an angular disposition of less than 90° such as, but not limited to 30°, 45° etc. relative to the remainder of the rear segment. However, when the back support is in the collapsed position it is preferably disposed in aligned, substantially coplanar relation to the rear segment and in at least one embodiment may be inserted partially in an appropriate recessed or open area formed in the rear segment.

Also, when the back support is in the outwardly extending position, a back support arm is movably connected to a remainder of the back support and positioned outwardly therefrom, such that the outer and/or extremity thereof is removably disposed in engaging relation with a length of the base and/or a length of a correspondingly disposed portion of the rear segment of the base.

Yet additional structural and operative features of the support assembly of the present invention comprises at least some of the aforementioned components such as, but not limited to, the armrest structure and portions of the elongated leg structure being removably or detachably connected to remainder of the support assembly to facilitate packing, storage, shipping, etc. More specifically, when so detached the various components of the support assembly may be collectively arranged to assume a smaller volume or area and then be easily reassembled when ready for use.

As will be explained in greater detail hereinafter, the movable, repositioning of the various components of the support assembly may be easily and quickly accomplished when the support assembly is being selectively disposed between the chair configuration and the bench configuration. Similarly, when in the bench configuration, adjustment and relative connected disposition of at least some of the components of the support assembly may be efficiently accomplished when it is desired to dispose the bench configuration in the aforementioned angularly reclined position and/or adjust the back support into its various angular orientations.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIGS. 7A-7E collectively and successively demonstrate adjustable positioning of the various components of the support assembly to accomplish an outwardly extending positioning of a back support associated with the bench configuration of FIG. 1B.

FIG. 13 is a perspective view in at least partially exploded form of one embodiment of the support assembly of the present invention in at least a partially a disassembled mode.

Like reference numerals refer to like parts throughout the several views of the drawings.

DETAILED DESCRIPTION OF THE PREFERRED EMBODIMENT

The invention now will be described more fully hereinafter with reference to the accompanying drawings in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1A:
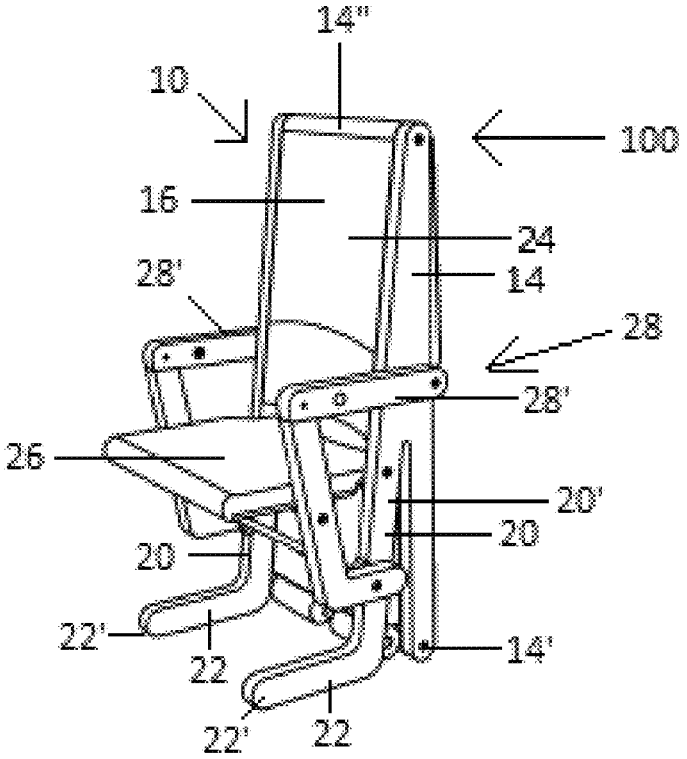
FIG. 1A is a perspective view of one embodiment of the support assembly of the present invention in a chair configuration.
Figure 1B:
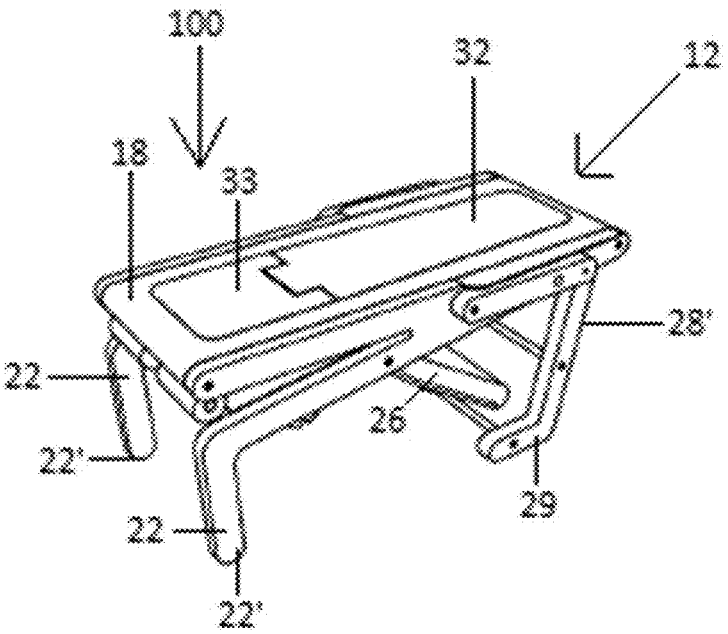
FIG. 1B is a perspective view of the embodiment of the support assembly, as represented in FIG. 1A, in a bench configuration.

As represented in FIGS. 1A and 1B, the present invention is directed to a support assembly generally indicated as 100 respectively disposed in a first supportive orientation at least partially defined by a chair configuration 10 and a second supportive orientation at least partially defined by a bench orientation 12, each of the chair configuration 10 and the bench configuration 12 is operatively disposed on a supporting surface 200.

The support assembly 100, regardless of its selective disposition in either the chair orientation 10 or the bench orientation 12 comprises an elongated base 14 comprising a front segment 16 and a rear segment 18 being disposed on opposite sides of the base 14 in opposed relation to one another. In addition, the base 14 includes an elongated leg 20 preferably but not necessarily fixedly or integrally secured to the base 14 in outwardly spaced, separated relation thereto. The elongated leg structure 20 includes an outer or free end 22 extending transversely outward from the remainder of the length of the elongated leg structure 20. As represented, the leg structure 20 includes a pair of spaced apart legs 20' extending along or defining opposite longitudinal sides of the base 14, where in each of the legs 20' include the one free or outer end 22.

The chair configuration 10 comprises a backrest 24, a seat 26 and an armrest structure 28 movably and collectively connected to one another to define a substantially upright position of the support assembly 100 when in the chair configuration 10, as represented in at least FIG. 1A. Moreover, the armrest structure 28 comprises a pair of armrests 28' disposed in spaced relation to one another, wherein each of the pair of armrests 28', when in the chair configuration 10, are disposed in an arm supporting position, relative to the arms of a seated individual (not shown for purposes of clarity). In cooperation therewith, the seat 26 and the backrest 24 will be cooperatively disposed in a substantially conventional supporting position relative to one another and to a seated individual, so as to adequately support corresponding body parts of the seated individual.

The support assembly 100 further comprises the aforementioned elongated leg structure 20 which may be connected to the base and includes one outer or free end 22 extending transversely outward from the remainder of the leg structure 20 and from the front segment 16 concurrent to disposition in of the assembly 100 in the chair configuration 10. Moreover, support for the chair configuration 10 comprises the one outer or free end 22 of each of the pair of legs 20' as well as a correspondingly positioned end 14' of the base 14 being concurrently disposed in engaging relation to the supporting surface 200. As such, the disposition of at least a majority of the length of the one end of each of the pair of support legs 20' is accomplished by the spaced, separated relation of the elongated leg structure 20 from the remainder of the base 14 along an entirety or at least a majority of the length of the elongated leg structure 20, including both of the elongated legs 20'. As such, the one end 22 of each of the elongated legs 20' are also disposed in outwardly spaced relation to the base 14. Further, in one or more embodiments the leg structure 20, including the two spaced apart legs 20' extend in spaced, separated relation from base 14 to define what may be accurately described as a bifurcated construction.

As set forth above, the alternate or second supportive orientation is at least partially defined by the bench configuration 12, wherein the rear segment 18 of the base 14 is disposed in an outwardly or upwardly exposed, reclined position, as represented in at least FIG. 1B. Such an outwardly or upwardly exposed reclined position is concurrent to the front segment 16 being disposed in a downwardly, substantially nonexposed position, by virtue of it facing the support surface 200 on which the bench configuration 18 of the support assembly 100 is disposed. The aforementioned reclined position of the bench configuration 12 may be accurately defined and disclosed as a substantially horizontal orientation, as represented in at least FIG. 1B or alternatively an angularly inclined orientation, as represented in at least FIG. 3. Both of the substantially horizontally reclined positions of FIG. 1B and the angularly inclined position of the bench configuration 12, as represented in at least FIG. 3, facilitate the support of an individual on the exposed surface of the rear segment 18.

Figure 3:
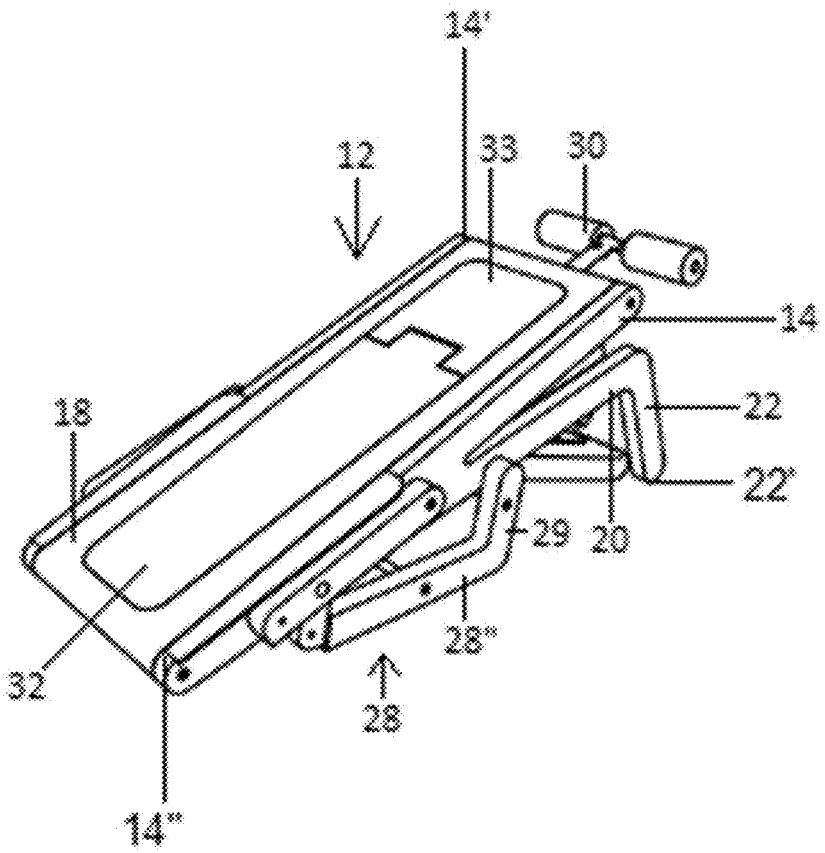
FIG. 3 is a perspective view of the bench configuration of FIG. 1B in an angularly inclined position.

As also represented in at least FIG. 1B, when in the substantially horizontal, inclined position, the bench configuration 12 is supported by the outermost extremity 22' of the outer end 22 of each of the legs 20' of the leg structure 20, and concurrently with the outer extremities or ends 29 of both the armrests 28' of the arm rest structure 28. Alternately, when the rear segment 18 is disposed in an angularly inclined position as represented in at least FIG. 3, support therefore comprises concurrent engagement with the support surface 200 of an outer extremity 22' of the outer end 22 of each of the support legs 20' and at least a majority of the length, as at 28", of each of the armrests 28' of the armrest structure 28. As also represented in FIG. 3 one end of the base 14, as at 14" may also be disposed in supporting engagement with the support surface 200, when the bench configuration 12 is in the inclined orientation. In at least one alternate embodiment, the end 14" may remain spaced above the support surface 200.

Figure 4A:
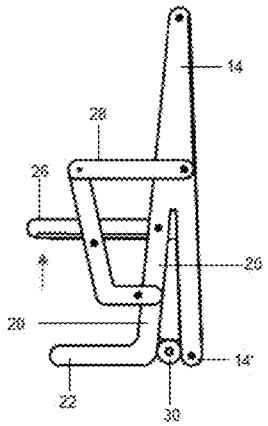
FIGS. 4A-4C; 5A-5B and 6A-6B are side views representing adjustable repositioning of the various components of one embodiment of the support assembly from the chair configuration of FIG. 1A to the bench configuration of FIG. 1B.
Figure 4B:
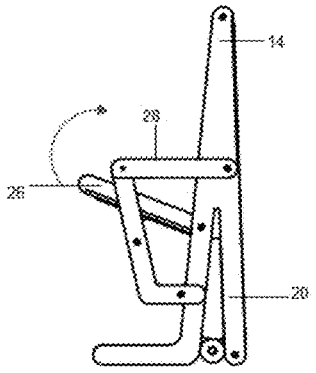
Figure 4C:
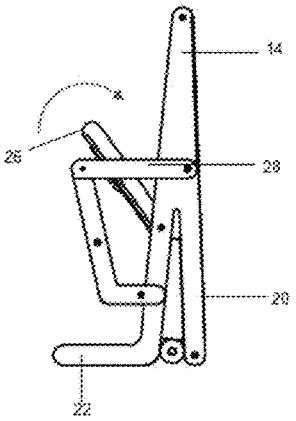

Also demonstrated throughout the Figures and as clearly represented in FIG. 3, a foot extension 30 may extend longitudinally outward from the end of 14' of the base 14 in support of an individual's feet, when the individual is supported on the inclined or reclined bench configuration 12. However, when selectively disposed in a stored orientation, as represented in FIGS. 4A-4C, the foot extension 30 may be retracted and disposed in the spacing between the elongated leg 20 and the correspondingly positioned portion or length of the frame 14.

Therefore, the versatility of the support assembly 100 includes structural and operative features which facilitate support thereof in the chair configuration 10 and the bench configuration 12 by different portions of at least the base 14, the armrest structure 28 and outer ends 22 of the leg structure 20 being movably, removably and/or relatively positioned so as to engage a supporting surface 200. By way of example, the armrest structure 28 is movably connected to the base 14 and selectively positioned between the aforementioned arm supporting position relative to a seated individual, when in the chair configuration of FIG. 1B. Alternatively, the armrest structure 28 is disposed into engagement with the supporting surface 200 and supporting relation to the base 14 concurrent to the support assembly 100 being disposed in the bench configuration 12.

Figure 2A:
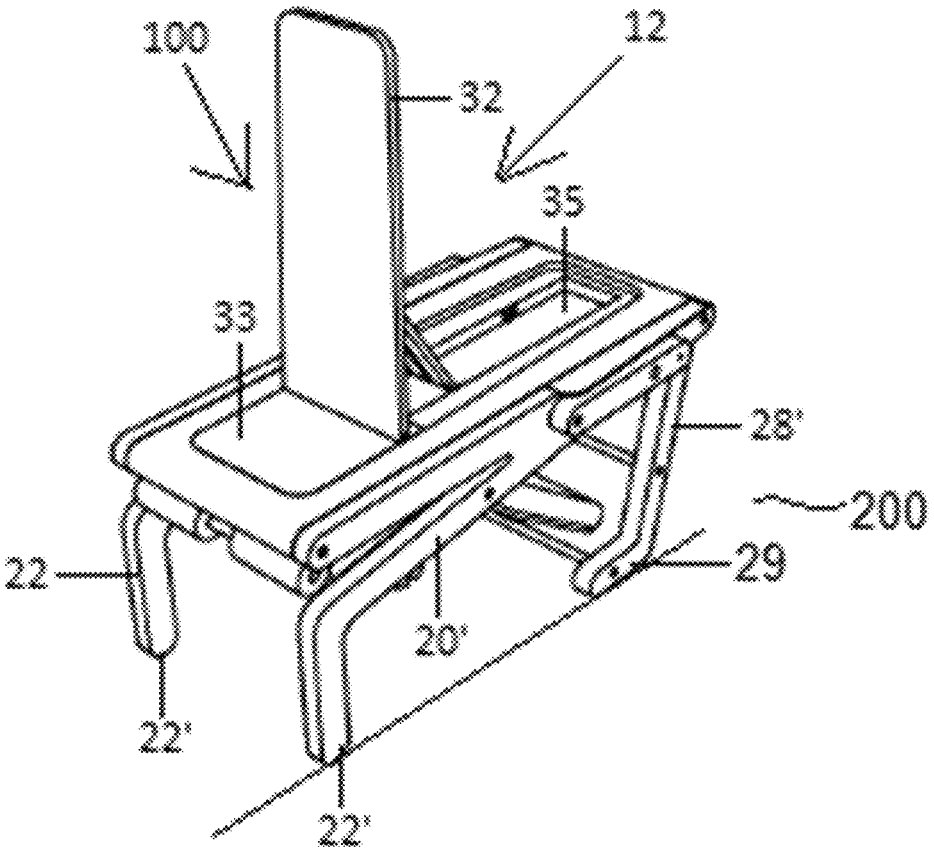
FIG. 2A is a perspective view of the present invention in a bench configuration with an outwardly extended back support.
Figure 2B:
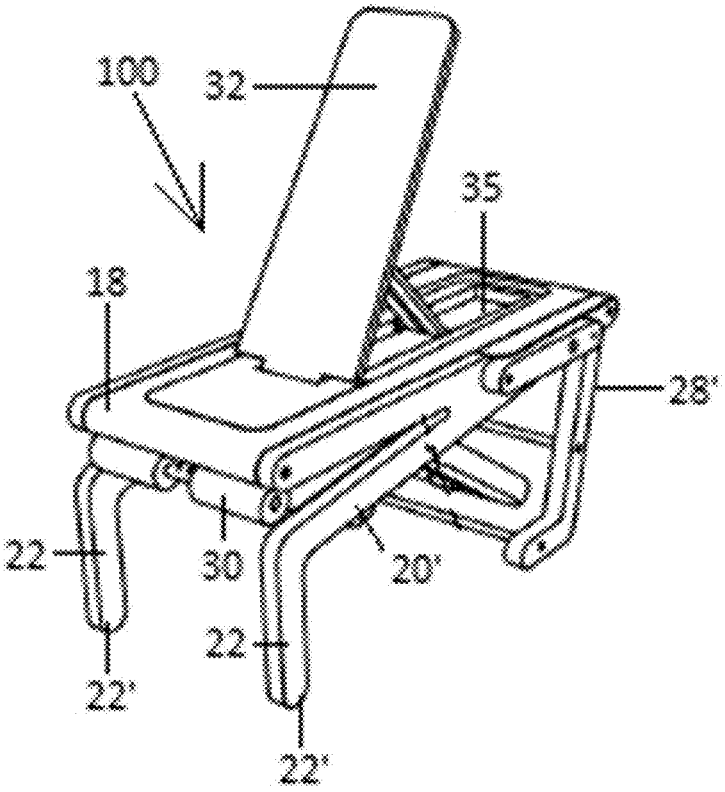
FIG. 2B is a perspective view similar to the embodiment of FIG. 2A in a different angular supportive position.

Additional structural operative features of support assembly 100 include the rear segment 14 comprising a back support 32 and an adjacent support segment 33, wherein the back support segment 32 is movably connected to the base 14 and to the rear segment 18. As such the backrest 32 is alternatively disposable in a collapsed position as represented in at least FIG. 1B and/or in an outwardly extended position, as represented in FIGS. 2A and 2B, concurrent to the support assembly 100 being in the bench configuration 18. Moreover, when the back support 32 extends outwardly from the base 14 and/or rear segment 18, it may be disposed in a transverse, substantially perpendicular relation to the rear segment 18, as in at least FIG. 2A. Alternatively, the backrest 32 may be disposed in one of the plurality of angular transverse orientations as represented in at least FIG. 2B. As such, the angular disposition of the backrest 32 may be less than 90° such as, but not limited to 30°, 45° etc. relative to the base 14 and remainder of the rear segment 18. However, when the back support 32 is in the collapsed position of at least FIG. 1B, it is preferably disposed in aligned, substantially coplanar relation to the rear segment 18 and in at least one embodiment may be at least partially inserted in an appropriate recess or open area 35, formed in the rear segment 18.

Also, when the back support 32 is in the outwardly extended position, a back support arm 34 is movably connected to a remainder of the back support (and/or to the base 14) and positioned outwardly therefrom, such that the outer end/or extremity 34' thereof is removably disposed in engaging relation with a length of the base 14 and/or a length of a correspondingly disposed portion of the rear segment 18.

Figure 14:
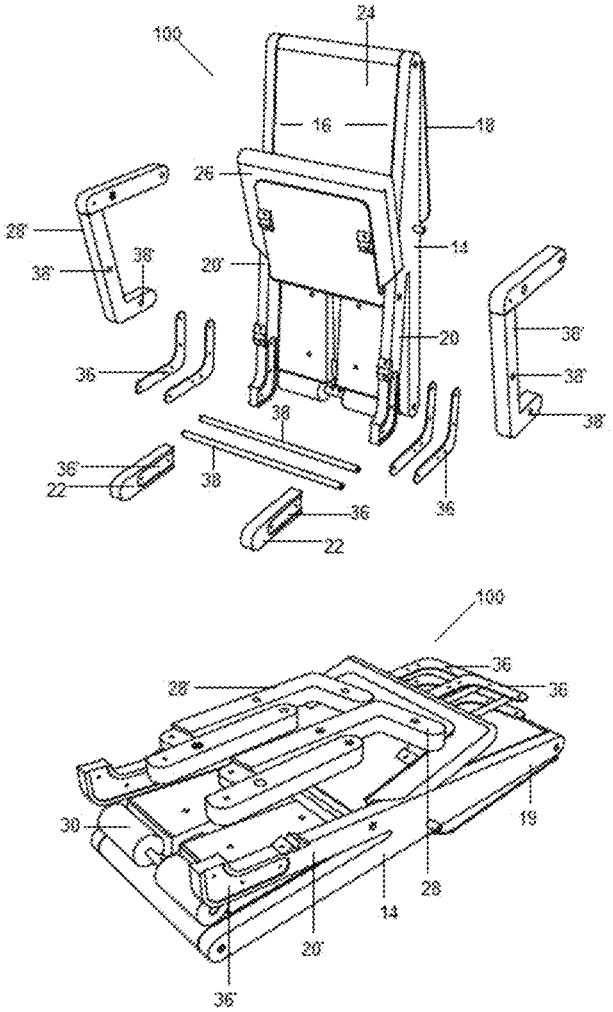
FIG. 14 is a perspective view of a collection of the components of one embodiment of the support assembly of the present invention in a reduced volume configuration.

Yet additional structural and operative features of the support assembly 100 as represented in FIGS. 13 and 14 comprise at least some of the aforementioned components such as, but not limited to, the armrest structure 28 and portions of the elongated leg structure 20, being removably or detachably connected to other portions or components of the support assembly 100 to facilitate packing, storage, shipping, etc. More specifically, when so detached the various components of the support assembly 100 may be collectively arranged to assume a smaller volume or area, as represented in FIG. 14 and then be easily reassembled into either of the chair configuration 10 or bench configuration 12, when ready for use.

In even more specific terms and with reference to FIGS. 13 and 14, the base 14 may be at least partially intact, wherein the backrest 24 and the seat 26 may remain connected to the base 14. The armrest structure 28 including the pair of armrests 28' may be detached as represented. Similarly, the outer ends 22 of each of the support legs 20' of the support leg structure may be removably connected using connecting brackets 36. In cooperation therewith, portions of the elongated support legs 20' and the outer ends 22 may include recessed areas 36' for insertion and connection of the support/connecting brackets 36. Also, a plurality of at least two elongated braces or support rods may be secured to inner portions of the spaced apart armrests 28', as at 38'. When so assembled, the elongated braces or support rods 38 serve to support an under portion of the seat 26, when in the chair configuration 10 as represented in at least FIG. 1A as well as support and under portion of the base 14 on the pair of armrests 28', when in the inclined bench configuration 12 as represented in at least FIG. 3.

As will be explained in greater detail hereinafter, the movable, repositioning of the various components of the support assembly 100 may be easily and quickly accomplished when the support assembly 100 is being selectively disposed between the chair configuration 10 and the bench configuration 12. Similarly, when in the bench configuration 12, adjustment and relative connected disposition of at least some of the components of the support assembly 100 may be efficiently accomplished when it is desired to dispose the bench configuration 12 in the aforementioned angularly reclined position and/or adjust the back support 32 into its various angular orientations.

Figure 5A:
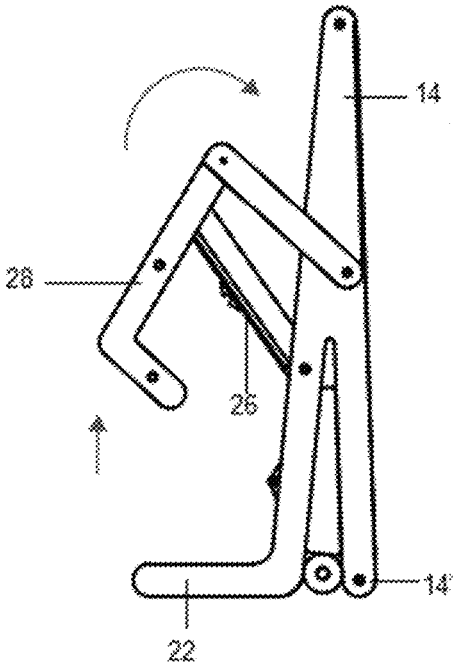
Figure 5B:
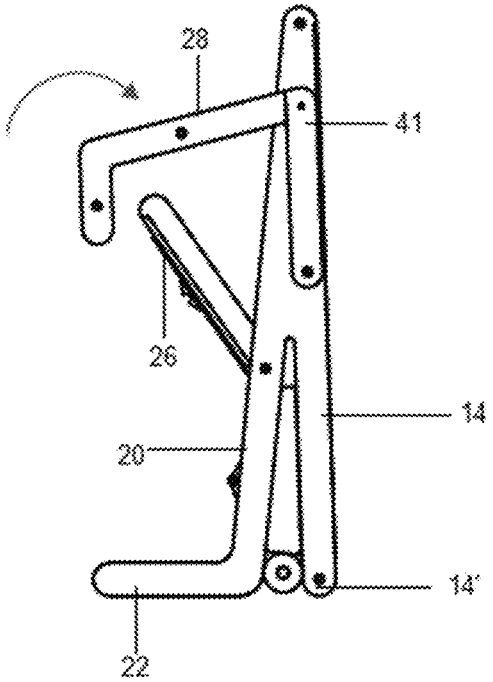

More specifically and with reference to FIGS. 4A-4C; 5A-5B and 6A-6B the chair configuration 10 may be readily disposed into the reclined, substantially horizontal bench configuration 12, as in FIG. 1A, by performing the following successive steps as further emphasized by the included directional arrows. The aforementioned successive steps include raising the seat 26 to a 45° angle as represented in FIGS. 4A-4 C. Thereafter, raise the arm rest structure 28 including both of the armrests 28' so as to clear, the seat 26 and secure the armrests 28' to the base as at 41, as represented in FIGS. 5A-5B. Subsequently there to, push the base 14 over into a substantially horizontal position, as represented in FIGS. 6A and 6B. In such a flat, substantially horizontal reclined orientation of the bench configuration 12 as clearly represented in FIG. 6B, the extremity 22' of the outer end 22 of the elongated support arm 20 will be disposed in engaging relation with a supporting surface 200. Concurrently the end 29 of each of the armrests 28' will be disposed in engaging relation with the supporting surface 200 and collectively the end 29 and the extremity 22' will provide proper support for the bench configuration 12 in the flat, substantially horizontal, reclined position of the bench configuration 12.

Figure 7E:
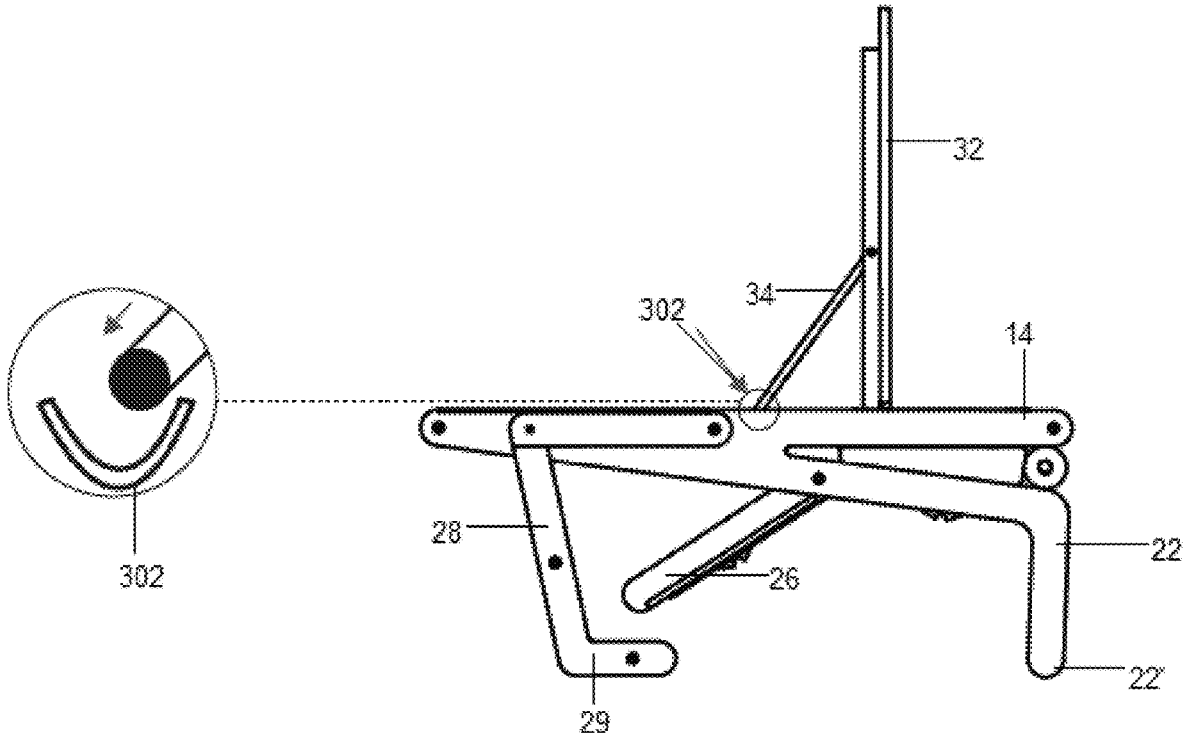

When the support assembly 100 is in the bench orientation 12, FIGS. 7A-7D will successively represent the procedures for orienting the back support 32 in an angular position of generally about 45°. The back support 32 is pulled to release it from the collapsed position relative to the rear segment 18. The back support 32 is lifted and the back support arm 34 is lowered as represented in FIGS. 7B and 7C. Thereafter the outer extremity of the backrest support arm 34 is secured to an appropriate length of the base 14 and/or rear segment 18 as represented in detail at 300. FIG. 7E represents the back support 34 being oriented relative to the base 14 and/or rear segment 18 in a substantially upright, perpendicular orientation. As such the same procedural steps are involved as represented in FIGS. 7A-7C. Thereafter, the back support arm 34 is removably disposed in engaging relation to a length of the base 14 and or rear segment 18 at a different location 302.

Figure 8A:
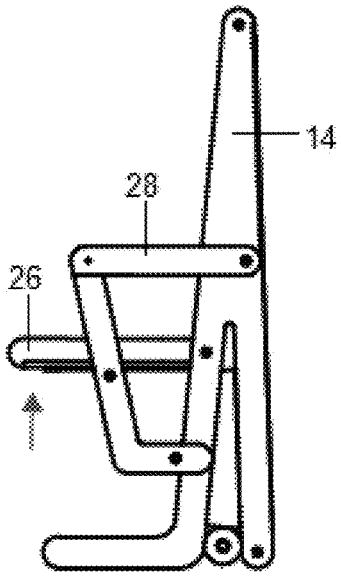
FIGS. 8A-8C; 9A-9B; 10A-10B; 11A-11C and 12A-12B successively demonstrate adjustable positioning of the various components of the support assembly to accomplish conversion from the chair configuration of FIG. 1A to an angularly inclined position of the bench configuration of the embodiment of Figure.
Figure 8B:
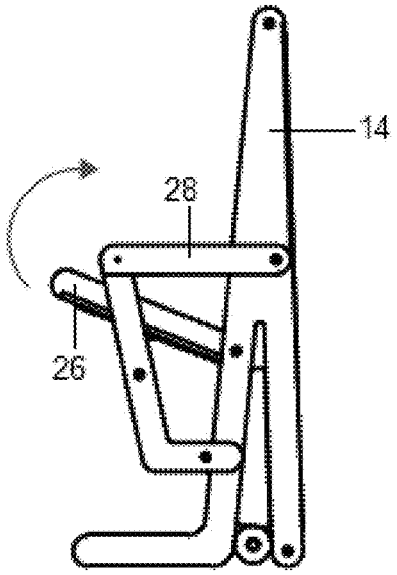
Figure 8C:
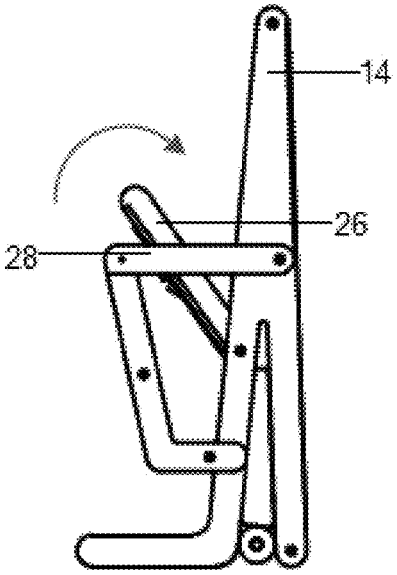
Figure 9A:
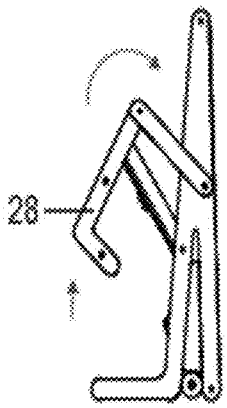
Figure 9B:
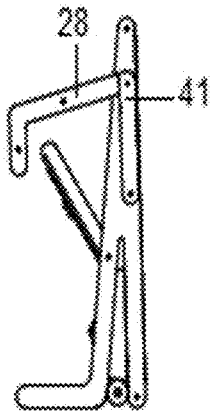
Figure 10A:
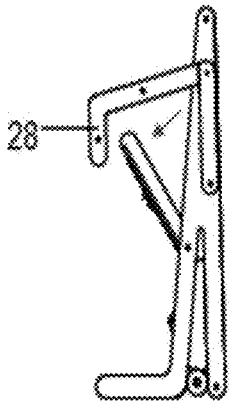
Figure 10B:
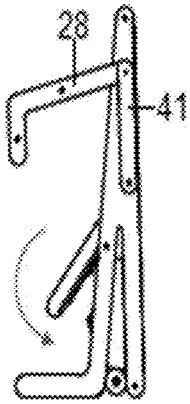

FIGS. 8A-8C; 9A-9B; 10A-10B; 11A-11C and 12A-12B successively represent the adjustable positioning of the various components of the support assembly 100 to accomplish the conversion thereof from the chair configuration 10 of FIG. 1A to an angularly inclined position of the bench configuration 12, as represented in FIG. 3. As represented in FIGS. 8 A-8C, the seat 26 is raised in accordance with the directional arrows to an approximate 45° angle. Thereafter, as represented in FIGS. 9A-9B, and FIGS. 10A-10B, the armrests 28' are raised to facilitate the lowering of the seat 26 to an out-of-the-way location as represented in FIG. 10B. Thereafter safety connectors 41 are released on both sides of the armrests 28' thereby allowing a lowering of the armrests 28' into the position represented in FIGS. 11B and 11C. The support assembly is the then pushed over into an inclined position as represented in FIGS. 12*a*-12B and the foot extension 30 is extended outwardly, if needed, for support of an individual's feet.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An assembly for supporting an individual in a plurality of different orientations, said assembly comprising:

an elongated base including a front segment and a rear segment, said front and rear segments disposed on opposite sides of said base and extending along at least a majority of the length of said base, said base disposable in a first supportive orientation and a second supportive orientation, said first supportive orientation comprising said front segment disposed in a chair configuration, and said second supportive orientation comprising said rear segment disposed in a bench configuration, said bench configuration comprising said rear segment disposed in an outwardly exposed substantially reclined position, and said rear segment comprising a back support movably connected to said base and alternatively disposable in a collapsed position and in an outwardly extended position, concurrent to disposition of said base in said bench configuration.

2. An assembly for supporting an individual in a plurality of different orientations, said assembly comprising:

an elongated base including a front segment and a rear segment, said front and rear segments disposed on opposite sides of said base and extending along at least a majority of the length of said base, said base disposable in a first supportive orientation and a second supportive orientation, said first supportive orientation comprising said front segment disposed in a chair configuration, said chair configuration comprising a backrest, a seat and an armrest structure movably and collectively connected to one another to define a substantially upright position of said chair configuration, said second supportive orientation comprising said rear segment disposed in a bench configuration, said bench configuration comprising said rear segment disposed in an outwardly exposed reclined position, and said reclined position further comprising said rear segment disposed in a substantially angularly inclined orientation, concurrent to an outer end of said leg structure and the majority of a length of said arm rest structure engaging a supporting surface in supporting relation to said base.

3. The assembly as recited in claim 2 further comprising an elongated leg structure connected to said base and having one end extending transversely outward from said front segment, said one end disposed in engaging relation to a supporting surface in supporting relation to said base, concurrent to disposition of said base in said chair configuration.

4. The assembly as recited in claim 3 wherein said elongated leg structure is connected to said base; said one end and at least a majority of a length of said elongated leg structure is separated from and spaced outwardly from said base.

5. The assembly as recited in claim 3 wherein said elongated leg structure comprises a pair of elongated spaced apart legs, each having one free end.

6. The assembly as recited in claim 2 wherein said reclined position comprises said rear segment disposed in a substantially horizontal orientation, concurrent to outer ends of said leg structure and said armrest structure concurrently disposed in engaging relation to a supporting surface and in supporting relation to said base.

7. The assembly as recited in claim 2 wherein said armrest structure is movably connected to said base and selectively positioned between an arm supporting position, concurrent to said chair configuration, and into engagement with a supporting surface, and supporting relation to said base, concurrent to said bench configuration.

8. The assembly as recited in claim 1 wherein said collapsed position comprises said back support disposed in substantially coplanar relation to said rear segment.

9. The assembly as recited in claim 1 wherein said outwardly extended position comprises said back support disposable in any one of a plurality of transverse, angular positions, relative to a remainder of said rear segment.

10. The assembly as recited in claim 9 further comprising a back support arm movably connected to said back support and including a free outer end disposable in engagement with different portions of said base, along a length of said rear segment, to define a supporting relation with said back support in different ones of said plurality of transverse, angular positions.

11. A support assembly for an individual convertible into a plurality of different supportive orientations, said support assembly comprising:

an elongated base including a front segment and a rear segment, an elongated leg structure connected to said base and having one end extending transversely outward from a remainder of said leg structure, said front and rear segments disposed on opposite sides of said base and each extending along at least a majority of the length of said base, said base disposable in a first supportive orientation and a second supportive orientation, said first supportive orientation comprising said front segment disposed in a chair configuration, said chair configuration including an armrest structure, said second supportive orientation comprising said rear segment disposed in a bench configuration, said chair configuration comprising at least a majority of a length of said one end and a correspondingly positioned end of said base disposed in engaging relation to a supporting surface, and said bench configuration comprising an outer extremity of said one end and a majority of a length of said armrest structure disposed in engaging relation to a supporting surface.

12. The support assembly as recited in claim 11 wherein said bench configuration comprises said rear segment disposed in an outwardly exposed reclined position; said reclined position variably oriented between a substantially horizontal orientation and an inclined orientation.

13. The support assembly as recited in claim 11 wherein said armrest structure is movably connected to said base and selectively positioned between an arm supporting position, concurrent to said chair configuration, and into said engagement with the supporting surface, concurrent to said bench configuration.

14. The support assembly as recited in claim 11 wherein said elongated leg structure is fixedly connected to said base; said one end and at least a majority of a length of said elongated leg structure is separated from and spaced outwardly from said base.

15. The support assembly as recited in claim 11 wherein said chair configuration comprises a backrest, a seat and said armrest structure movably connected to one another said base, said backrest, said seat and said armrest structure removably connected to one another and disposable in a reduced volume stored orientation.

16. The assembly as recited in claim 2 wherein said armrest structure comprises a pair of armrests disposed in spaced relation to one another.

* * * * *